United States Patent [19]

Mangano

[11] Patent Number: 4,505,219

[45] Date of Patent: Mar. 19, 1985

[54] ADJUSTABLE BOOKMARK FOR PAPERBACK AND HARD COVER BOOKS

[76] Inventor: Mary G. Mangano, 1525 E. Putnam Apt. 305, Old Greenwich, Conn. 06370

[21] Appl. No.: 562,230

[22] Filed: Dec. 16, 1983

[51] Int. Cl.[3] ..... B42D 9/00

[52] U.S. Cl. ..... 116/234; 116/239; 281/42

[58] Field of Search ..... 116/234–239; 281/42; 119/106, 109

[56] References Cited

U.S. PATENT DOCUMENTS

| | | | |
|---|---|---|---|
| 2,543,182 | 2/1951 | Lang | 116/235 |
| 2,716,390 | 8/1955 | Goins | 116/235 |
| 3,603,295 | 9/1971 | Shuman | 119/106 |
| 3,898,951 | 8/1975 | Clare | 116/239 |
| 4,041,892 | 8/1977 | Nichols | 116/239 |

FOREIGN PATENT DOCUMENTS

| | | | |
|---|---|---|---|
| 0838093 | 6/1960 | United Kingdom | 119/106 |

*Primary Examiner*—Charles Frankfort
*Assistant Examiner*—W. Morris Worth
*Attorney, Agent, or Firm*—Bollo & Drumm

[57] ABSTRACT

An adjustable bookmark for paperback and hard cover books including an integral non-stretchable member having an adjustable loop portion and a marker portion, the adjustable loop portion being adapted to fit around one cover of a book, adjustable loop defining member affixed to one end of the non-stretchable member and operatively engaging another portion of the non-stretchable member to define the adjustable loop portion, the remainder of the non-stretchable member extending from the adjustable loop defining member defining the marker portion, a decorative member attached to the marker portion at a position remote from the end of the adjustable loop portion so that when the size of the adjustable loop is adjusted by moving the adjustable loop defining member to fit tightly around one cover of book and the adjustable loop defining member is positioned adjacent the top of such a cover, the marker portion will extend downwardly from the adjustable loop defining member and may be positioned to mark a desired page of the book with the decorative member aiding in pulling the marker portion downwardly. Further, the marker portion is dimensioned so that the decorative member will extend slightly beyond the bottom of the book when the marker portion is marking the desired page of the book.

2 Claims, 5 Drawing Figures

Fig. 1.
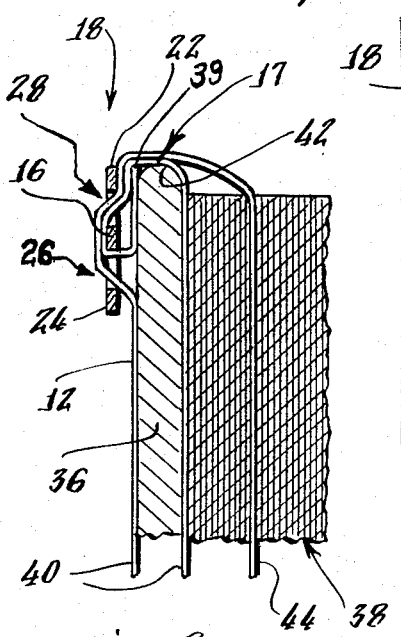
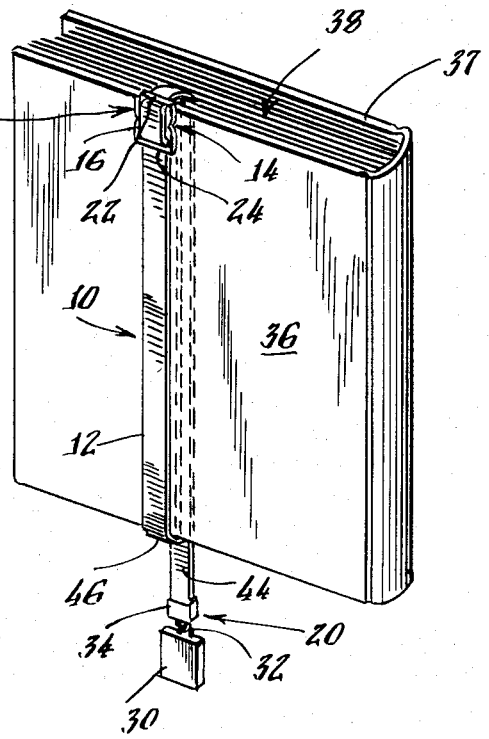
Fig. 2.
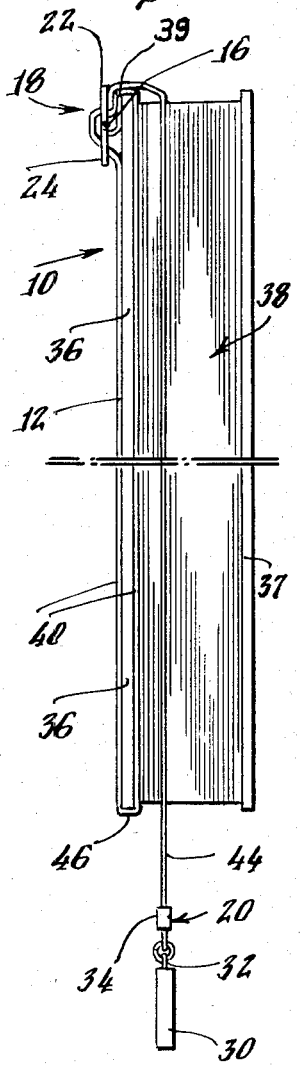
Fig. 3.
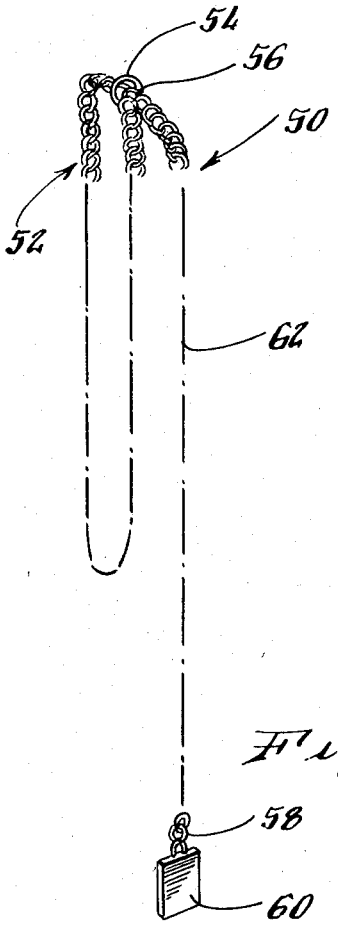
Fig. 4.
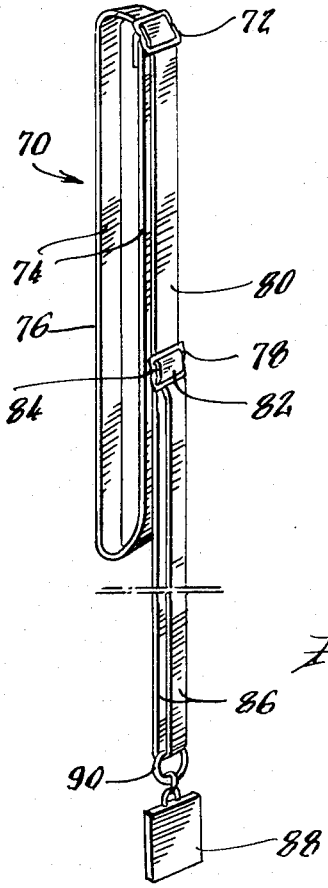
Fig. 5.

ADJUSTABLE BOOKMARK FOR PAPERBACK AND HARD COVER BOOKS

BACKGROUND OF THE INVENTION

The present invention relates to bookmarks, and more specifically to adjustable bookmarks for use with paperback and hard cover books.

Providing a simple, attractive and effective bookmark which is retained in the book to prevent loss or misplacement and is capable of being used with paperbacks as well as hard cover books has been a long standing problem which has faced the book industry. Various approaches have been tried to provide a bookmark which solves this long lasting problem. Perhaps the first approach was to place a single marker beteen the pages. Another approach was to provide a clip-on marker. A third approach was to affix a ribbon type marker to the binding of a book.

Various other bookmark constructions are also known. U.S. Pat. No. 2,716,390 to A. L. Goins discloses a belt and buckle arrangement which extends around the pages and one cover of a book with a slidable arrow affixed to the belt to mark a particular point on a page. U.S. Pat. No. 3,020,876 to K. R. Riden discloses a combination bookmark and loose-leaf binder including a plastic strip with a thread and eyelet for positioning the loose-leaf binder between the binding and the adjacent cover portion of a hard cover book.

U.S. Pat. No. 3,898,951 to G. M. Clare discloses a bookmark in the form of an integral stretchable elastic member having a marker portion which extends upwardly in a potentially dangerous manner which may snag on objects. Further, the marker portion extends downwardly a substantial distance from the bottom of the book and includes Velcro at its end to mate with another Velcro member on the loop portion of the elastic member. U.S. Pat. No. 4,041,892 to M. V. Nichols discloses a bookmark utilizing a plurality of elastic loops for attaching to the cover of a book with a plurality of markers affixed to the elastic loops to mark the pages of a book. The elastic loops are rotated to prevent unnecessary portions of the markers from extending beyond the bottom of the book. The elastic nature of these bookmarks makes them unsuitable for use with paperbacks.

None of the foregoing approaches have completely solved the aforementioned long standing problem of providing a simple, attractive and effective bookmark which is retained in the book to prevent loss or misplacement and is capable of being used with paperbacks as well as hard cover books.

SUMMARY OF THE INVENTION

It is an object of the present invention to provide an adjustable bookmark which overcomes the disadvantages of prior bookmarks.

It is a further object of the present invention to provide an adjustable bookmark which may be used on paperback and hard cover books.

It is a further object of the present invention to provide an adjustable bookmark which is retained in the book against loss.

It is a still further object of the present invention to provide an adjustable ribbon bookmark which does not damage the book.

It is a still further object of the present invention to provide an adjustable bookmark which is attractive in use.

It is a still further object of the present invention to provide an adjustable bookmark which is relatively simple and economical to construct.

Briefly, in accordance with the present invention, an adjustable bookmark for paperback and hard cover books is provided including an integral non-stretchable member having an adjustable loop portion and a marker portion, the adjustable loop portion being adapted to fit around one cover of a book, adjustable loop defining means affixed to one end of the non-stretchable member and operatively engaging another portion of the non-stretchable member to define the adjustable loop portion, the remainder of the non-stretchable member extending from the adjustable loop defining means defining the marker portion, a decorative member attached to the marker portion at a position remote from the end of the adjustable loop portion so that when the size of the adjustable loop is adjusted by moving the adjustable loop defining means to fit tightly around one cover of the book and the adjustable loop defining means is positioned adjacent the top of such a cover, the marker portion will extend downwardly from the adjustable loop defining means and may be positioned to mark a desired page of the book with the decorative member aiding in pulling the marker portion downwardly. Further, the marker portion is dimensioned so that the decorative member will extend slightly beyond the bottom of the book when the marker portion is marking the desired page of the book.

Other objects, aspects and advantages of the present invention will be apparent from the detailed description, considered in conjunction with the drawings, as follows:

BRIEF DESCRIPTION OF THE DRAWINGS

FIG. 1 is a perspective view of an adjustable bookmark in accordance with the present invention positioned on the back cover of a book;

FIG. 2 is a slide elevational view of the adjustable bookmark of FIG. 1 positioned in a book;

FIG. 3 is an enlarged view of the adjustable loop defining means positioned on the back cover of a book with the end of the loop engaging the top of the back cover;

FIG. 4 is a side elevational view of another embodiment of an adjustable bookmark in accordance with the present invention; and FIG. 5 is a side elevational view of another embodiment of adjustable bookmark in accordance with the present invention including a pendant adjustment loop.

DETAILED DESCRIPTION

Referring to FIG. 1, an adjustable bookmark in accordance with the present invention is generally illustrated at 10. The adjustable bookmark 10 includes an integral non-stretchable member 12, preferably constructed of a flat ribbon such as grosgrain or a metal chain. One end 14 of the non-stretchable member 12 is affixed to the central post 16 of an adjustable loop defining member 18, e.g., by a loop 17 sewn therearound, see FIG. 3. The other end 20 of the non-strechable member 18 is passed through the member 18 around the central post 16.

As best seen in FIG. 3, the adjustable loop defining member 18 includes a pair of symmetric frames 22 and 24 integrally formed with the central post 16 to provide slots or openings 26 and 28 for slidably receiving the other end 20 of the non-stretchable member 12. Affixed to the other end 20 of the adjustable bookmark 10 is a decorative charm or pendant 30, which provides a decorative appearance as well as weight to aid in pulling the other end 20 of the adjustable bookmark 10 downwardly when the book is held upright. Advantageously, the pendant 30 may be affixed to the other end 20 of adjustable bookmark 10 by, e.g., a link 32 which interconnects the pendant 30 to a clasp 34 which is press fitted to the end 20 of the adjustable bookmark 10.

Referring more particularly to FIGS. 2 and 3, the adjustable bookmark 10 is shown mounted on the back cover 36 of a book 38. Although it should be understood that the adjustable bookmark 10 may be mounted on the front cover 37, as desired. The adjustable bookmark 10 includes an adjustable loop portion 40 extending around the front cover 36 with the adjustable loop defining member 18 positioned adjacent the uppermost end or top 42 of the back cover 36 so that the portion of the non-stretchable member 12 which extends through the adjustable loop defining member 18 will extend downwardly therefrom forming a marker portion 44. The marker portion 44 is then placed on the desired page as illustrated in FIG. 2. Further, with the adjustable loop defining member 18 positioned adjacent the top 42 of the back cover 36 so that the end 39 of the loop 17 is abuting the top 42 of the cover 36 of the book 38 an effective stop is created to prevent rotation of the loop 40 about the cover 36 when force is applied to the marker portion 44. Specifically, the reader can hold the book 38 and/or adjustable loop defining member 18 in one hand and pull downwardly on the marker portion 44 to take up any slack in the adjustable loop portion 40 so that the adjustable loop portion 40 will fit tightly around the front cover 36. Moreover, as seen in FIGS. 1 and 2, the adjustable bookmark 10 may be constructed of various lengths so that when the adjustable loop portion 40 fits tightly around a certain size hard cover or paperback book, the other end 20 of the marker portion 44 with the attached pendant 30 will extend slightly below the bottom end 46 of the book 38.

Referring to FIG. 4, another embodiment of an adjustable bookmark in accordance with the present invention is illustrated generally at 50. The adjustable bookmark 50 is formed from an integral metal chain. A clasp 54 is affixed to one end of the adjustable bookmark 50. An adjustable loop 52 is formed by clipping the clasp 54 onto a desired link 56 of the chain 50. The other end 58 of the bookmark 50 includes a pendant 60 affixed thereto which extends beyond the bottom portion of the book (not shown) when the adjustable loop 52 is seated tightly around the back cover of the book with the clasp 54 positioned adjacent the top of the back cover of the book (not shown). That portion of the chain which extends from the link to which the clasp 54 is attached to form the loop 52 to the other end 58 is defined as the marker portion 62. The weight of the metal chain aids in pulling the marker portion 62 downward when the marker portion 62 is positioned at the desired page in the book.

Referring to FIG. 5, another embodiment of an adjustable bookmark in accordance with the present invention is illustrated generally at 70. The adjustable bookmark 70 is formed of a non-stretchable flat ribbon as described with reference to FIGS. 1, 2 and 3. However, in addition to having a first adjustable loop defining member 72 which forms an adjustable loop 74 in the non-stretchable member 76, the adjustable bookmark 70 includes a second adjustable loop defining member 78 with a portion of the marker portion 80 of the bookmark 70 slidably received by the second adjustable loop defining member 78 and the end 84 of the marker portion 80 extending around the central post 82 of the second adjustable loop defining member 78 to form a loop which is affixed to the central post 82, e.g., by sewing. Thus, a second adjustable loop 86 is formed in the adjustable bookmark 70 to adjust the position of the decorative member 88 relative to the bottom of the book (not shown) to fit books varying in length from paperbacks to most hard cover sizes. The decorative member 88 is movably attached to the marker portion 80, e.g., with a link or chain 90.

In use, the adjustable loop 40 of the embodiment in FIGS. 1, 2 and 3 is slipped over the back cover 36 of the book 38 or the adjustable loop 40 is enlarged by sliding the adjustable loop defining member 18 along the non-stretchable member 12 to provide a large enough loop 40 to fit over the back cover 36 of the book 38. The adjustable loop defining member 18 is then moved downwardly to a position adjacent the top 42 of the back cover 36 holding the adjustable loop defining member 18 and pulling on the marker portion 44. The marker portion 44 is then placed on the desired page; the weight of the pendant 30 helping to pull the marker portion 44 downwardly when the book 38 is held upright. As previously mentioned, any slack in the adjustable loop 40 is removed by holding the book 38 or adjustable loop defining member 18 and pulling downwardly on the marker portion 44.

When the embodiment shown in FIG. 4 is used, the metal chain 50 is placed over one cover of the book and the clasp 54 is affixed to selected link to form a loop 52 which snugly fits over the cover with the clasp 54 positioned at the top of the book cover. The marker portion 62 then hangs downwardly as previously described to mark a particular page.

When the embodiment of FIG. 5 is used, the loop 74 is adjusted to snugly fit around the back cover of a book in the same manner as described with reference to the embodiment of FIGS. 1, 2 and 3. Thereafter, the book may be held in one hand and slide member 78 grasped with the other hand and pulled downwardly to decrease the length of the loop 86, thereby increasing the length of the marker portion 80 as desired. Likewise, the length of the loop 86 may be increased, thereby decreasing the length of the marker portion 80, as desired, by holding the adjustable loop defining member 78 in one hand and pulling downwardly on the portion of the loop 86 which is not affixed to the central post 82.

It should be apparent to those skilled in the art that various modifications may be made in the present invention, such as employing other non-stretchable members, charms or other decorative members, without departing from the spirit and scope thereof, as described in the specification and defined in the appended claims.

What is claimed is:

1. An adjustable bookmark for paperback and hard cover books, comprising:

an integral non-stretchable member including an adjustable loop portion and a portion, having a free end;

said adjustable loop portion being adapted to fit around one cover of a book, the cover having a top edge and a bottom edge;

adjustable loop defining means affixed to one end of said non-stretchable member and operatively engaging another portion of said non-stretchable member to define said adjustable loop portion;

a portion of said non-stretchable member extends from said adjustable loop defining means to the distal end of the free end of said non-stretchable member defining a marker portion;

a decorative member attached to said marker portion at a position remote from the adjustable loop defining means so that when said adjustable loop is adjusted by moving said adjustable loop defining means to fit said adjustable loop portion tightly around one cover of a book and said adjustable loop defining means is positioned adjacent the top edge of the cover, said marker portion will extend downwardly from the adjustable loop defining means and may be positioned to mark a desired page of the book with said decorative member aiding in pulling said marker portion downwardly, said non-stretchable member being dimensioned so that when said adjustable loop portion fits tightly around the cover of the book and said marker portion is marking the desired page of the book said decorative member will extend slightly beyond the bottom edge of the cover; and a second adjustable loop defining means affixed to a first portion of said marker portion and slidably mounted to a second portion of said marker portion to form a second adjustable loop portion for further adjusting the location of said decorative member relative to the bottom edge of the cover.

2. An adjustable bookmark for paperback and hard cover books, comprising:

an integral non-stretchable member including an adjustable loop portion and a marker portion;

said adjustable loop portion being adapted to fit around one cover of a book, the cover having a top edge and a bottom edge;

adjustable loop defining means affixed to one end of said non-strechable member and operatively engaging another portion of said non-stretchable member to define said adjustable loop portion;

a portion of said non-stretchable member extends from said adjustable loop defining means to a free end of said non-stretchable member defining said marker portion;

a decorative member attached to said marker portion at a position remote from the adjustable loop defining means so that when said adjustable loop portion is adjusted by moving said adjustable loop defining means to fit the adjustable loop portion tightly around one cover of a book and said adjustable loop defining means is positioned adjacent the top edge of the cover, said marker portion will extend downwardly from the adjustable loop defining means and may be positioned to mark a desired page of the book with said decorative member aiding in pulling said marker portion downwardly, said non-stretchable member being dimensioned so that when said adjustable loop portion fits tightly around the cover of the book and said marker portion is marking the desired page of the book said decorative member will extend slightly beyond the bottom edge of the cover;

said adjustable loop portion and said integral marker portion are dimensioned to fit different length book covers so that said decorative member extends only slightly beyond the bottom edge of the cover when said marker portion is marking a page thereof;

said non-stretchable member is in the form of a flat ribbon;

said adjustable loop defining means includes a central post member to which one end of said non-stretchable member is affixed and a pair of symmetric frames integrally connected to said central post to provide slots for receiving said non-stretchable member to facilitate adjustments in said adjustable loop portion;

said adjustable loop portion may be readily tightened should it loosen during usage by having a reader grasp the book or said adjustable loop defining means with one hand and pulling downwardly on said marker portion with another hand; and a second adjustable loop defining means affixed to a first portion of said marker portion and slidably mounted to a second portion of said marker portion to form a second adjustable loop portion for further adjusting the location of said decorative member relative to the bottom edge of the cover.

* * * * *